US005380232A

United States Patent [19]

Berggreen et al.

[11] Patent Number: 5,380,232

[45] Date of Patent: Jan. 10, 1995

[54] TOY WITH SLIDE OPEN-SNAP SHUT ACCESS TO INTERIOR

[75] Inventors: Ib H. Berggreen, Rungsted; Jan Ryaa, Billund, both of Denmark

[73] Assignee: Interlogo A.G., Baar, Switzerland

[21] Appl. No.: 210,726

[22] Filed: Mar. 18, 1994

Related U.S. Application Data

[63] Continuation of Ser. No. 859,437, May 28, 1992, abandoned.

[30] Foreign Application Priority Data

Nov. 29, 1989 [DK] Denmark ..... 6016/89

[51] Int. Cl.[6] ..... A63H 33/04; A63H 17/00; A63H 17/26; B65D 43/20

[52] U.S. Cl. ..... 446/75; 446/78; 446/128; 446/470; 206/816; 206/205; 220/345

[58] Field of Search ..... 446/69, 71–74, 446/75–78, 93, 95, 117, 118, 127, 128, 470, 471; 206/816, 205, 223, 575; 217/62, 12 R; 220/329, 345, 350

[56] References Cited

U.S. PATENT DOCUMENTS

| | | | |
|---|---|---|---|
| Re. 10,114 | 5/1882 | Reed | 446/76 X |
| D. 252,977 | 9/1979 | Bayly | 446/71 X |
| 741,903 | 10/1903 | Gates | 446/71 X |
| 2,532,083 | 11/1950 | Brenner | 217/62 |
| 3,124,240 | 3/1964 | Croan | 206/223 X |
| 3,362,564 | 1/1968 | Mueller . | |
| 4,153,160 | 5/1979 | Leigh | 220/345 X |
| 4,225,202 | 9/1980 | Chandler | 217/62 X |
| 4,244,144 | 1/1981 | Goldberg et al. | 446/470 X |
| 4,342,403 | 8/1982 | Badtke et al. | 220/345 |
| 4,515,360 | 5/1983 | Mariol | 217/62 X |
| 4,571,205 | 2/1986 | Zaruba et al. | 446/470 X |
| 4,764,146 | 8/1988 | Auer et al. | 446/428 X |
| 4,804,349 | 2/1989 | Loscalzo et al. | 446/93 |
| 4,822,314 | 4/1989 | Obrian et al. | 456/75 |
| 4,872,410 | 10/1989 | Lilly | 446/128 X |
| 5,188,221 | 2/1993 | Bertrand | 446/128 X |
| 5,250,000 | 10/1993 | Boutin et al. | 446/128 X |

FOREIGN PATENT DOCUMENTS

| | | | |
|---|---|---|---|
| 1442582 | 7/1976 | United Kingdom . | |
| 8204195 | 12/1982 | WIPO | 446/93 |
| 9108032 | 6/1991 | WIPO | 446/470 |
| 9210255 | 6/1992 | WIPO | 446/75 |

*Primary Examiner*—Robert A. Hafer
*Assistant Examiner*—D. Neal Muir
*Attorney, Agent, or Firm*—Kane, Dalsimer, Sullivan, Kurucz, Levy, Eisele and Richard

[57] ABSTRACT

A toy with an accessible interior is provided with a sliding lid. The opposed sides of the lid and opposed upper sidewalls of the toy define a cooperating pair of grooves and guides so that the lid may be slid on and off the toy. The sidewalls and/or lid are sufficiently elastic to permit the lid to snap into position with the guides captured within the grooves when the lid is pressed downwardly into position.

6 Claims, 4 Drawing Sheets

TOY WITH SLIDE OPEN-SNAP SHUT ACCESS TO INTERIOR

This application is a continuation, of application Ser. No. 07/859,437, filed May 28, 1992, now abandoned.

BACKGROUND OF THE INVENTION

The invention concerns a toy with an accessible interior, e.g. a vehicle comprising a sliding wall with a pair of mutually parallel edges adapted to be received in a sliding groove in a pair of opposed walls of the toy.

A sliding lid of the above-mentioned type is known e.g. from the U.S. Pat. No. 3,362,564. This prior art can also be applied to toys, but is vitiated by the drawback that it is relatively difficult—in particular for infants—to guide a sliding wall into the grooves adapted for this purpose in the opposed walls.

The object of the invention is to provide a toy with an accessible interior, utilizing the advantages of the known sliding principle, while obviating the mentioned drawbacks of this principle.

SUMMARY OF THE INVENTION:

This is achieved in that the toy is constructed so that a sliding wall—in addition to being capable of being slid on and off—can also be caused to cooperate with the opposed walls by moving the sliding wall transversely to its plane. Preferably, the latter possibility will mostly be used when the toy is to be closed, while opening of the toy preferably takes place by a sliding movement in the plane of the sliding wall.

In one embodiment the guides are provided on the sliding wall and the grooves in the side wall, and in another embodiment the reverse is the case. This selection depends entirely upon the type of the toy, and examples of both possibilities will be given later.

The groove may be defined between the bottom of a rebate and a plurality of evenly distributed projections, and the elastic, mutual movement between the sliding wall and the opposed walls may be provided. Here too, the type of the toy decides what is most expedient.

A toy caravan is stated as an example where it is most expedient that the walls are elastically resilient, and the guides are provided on the walls. Alternatively a toy storage box may be provided where it is most expedient that the sliding wall is elastically resilient and that the grooves are provided in the walls.

BRIEF DESCRIPTION OF THE DRAWINGS:

The invention will be explained more fully below with reference to the drawing, in which FIG. 5 and 6 show the principle applied to a toy caravan, while

DETAILED DESCRIPTION OF THE PREFERRED EMBODIMENTS:

With reference to FIGS. 1–4 it will first be explained how a plate-shaped part can either be slid into a pair of opposed grooves or be pressed down into the groove, i.e. be slid in the plane of the plate or transversely to the plane of the plate, respectively.

Figure 1:
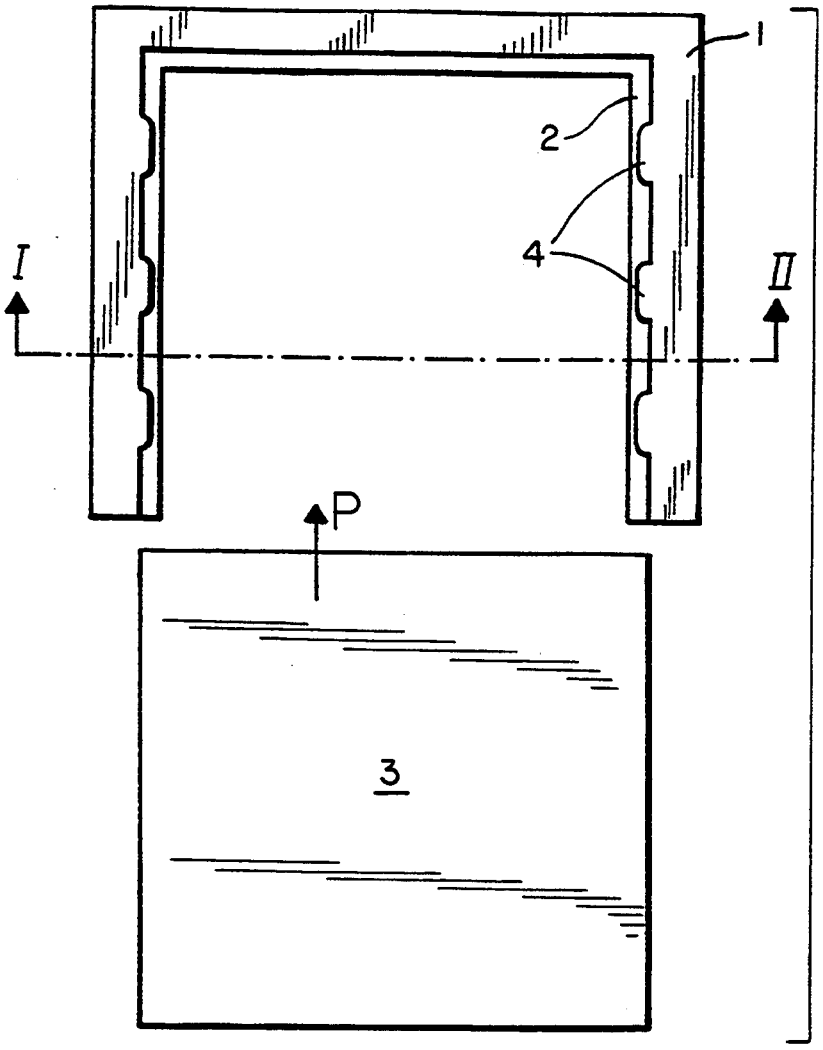
FIGS. 1–4 show the principle of the toy of the invention.

FIG. 1 shows a U-shaped frame 1 with an annular rebate 2, which is recessed somewhat below the upper side of the frame, corresponding to the thickness of a sliding wall 3 plus the thickness of a plurality of projections 4. Thus, the projection 4 and the rebate 2 define between them a groove for receiving the sliding plate 3, and it will be readily understood that the plate 3 can be slid into the groove in the direction shown by the arrow P in FIG. 1. However, it may be rather difficult for infants to guide the sliding wall into position. This drawback is obviated by the invention as set forth in the following explanation.

Figure 2:
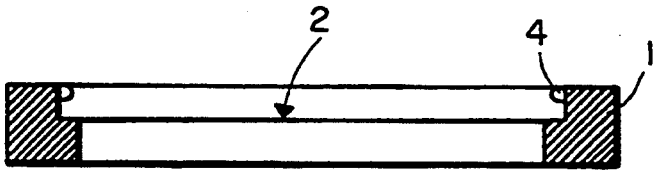
Figure 3:
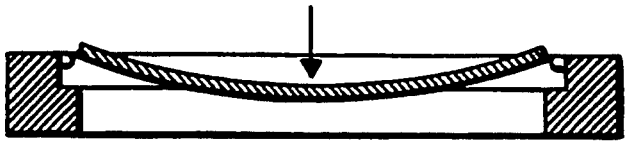
Figure 4:
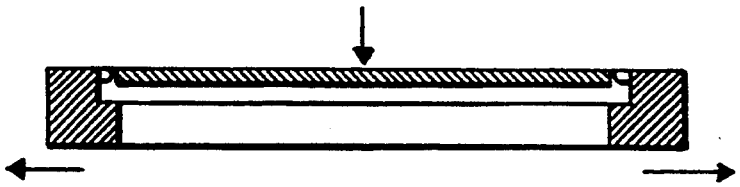

FIG. 2 shows a section taken along the line II—II in FIG. 1, which clearly shows that the plate can be accommodated between the projections 4 and the rebate 2. FIG. 3 shows first the possibility of the plate being flexible, so that the distance between the opposed edges of the plate can be diminished by bending down the plate. FIG. 4 illustrates that the legs of the U-shaped frame are elastically movable, as shown by the arrows in FIG. 4. It appears that the child can easily put the wall into position merely by pressing the wall down against the rebate 2.

Figure 5:
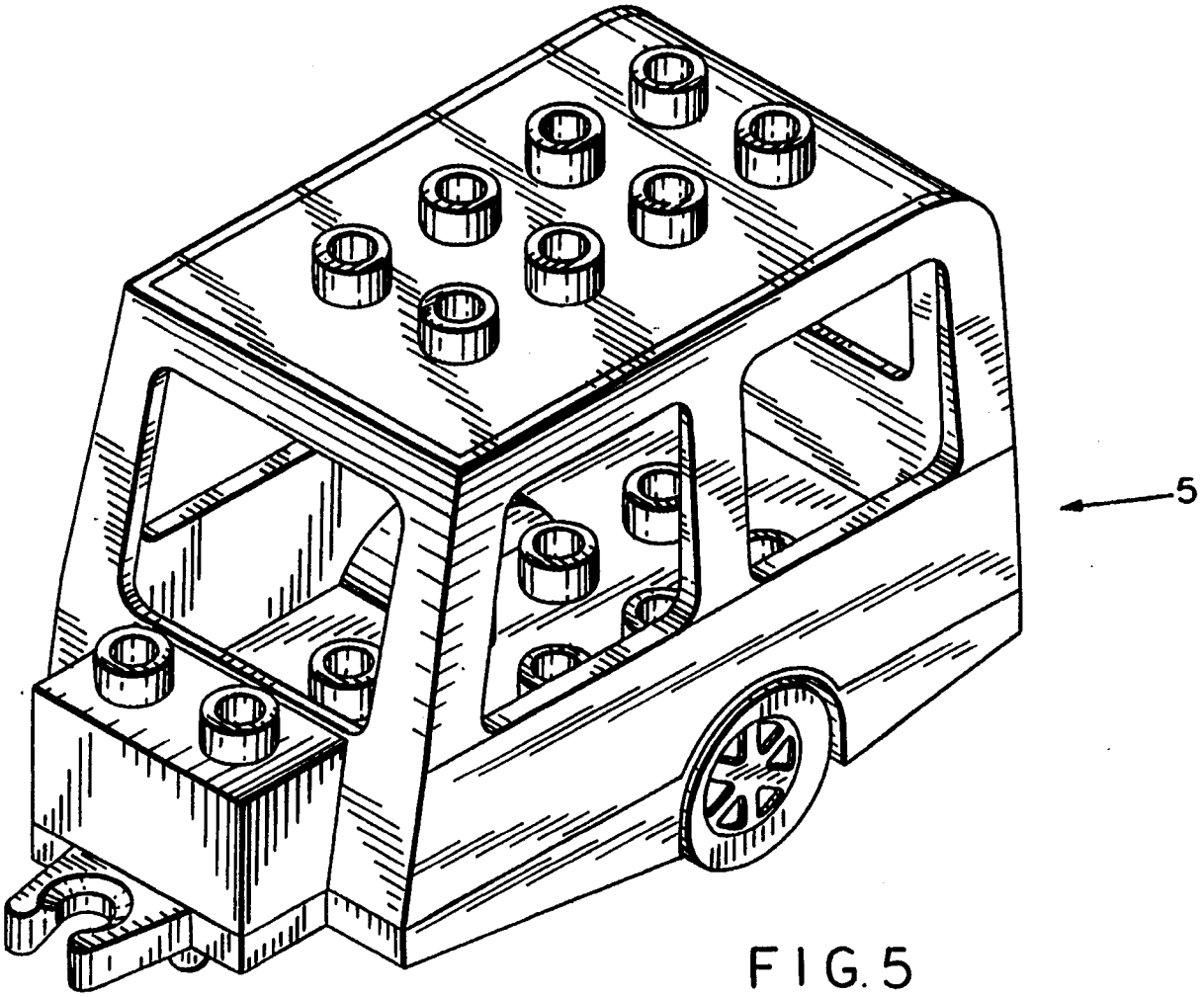
Figure 6:
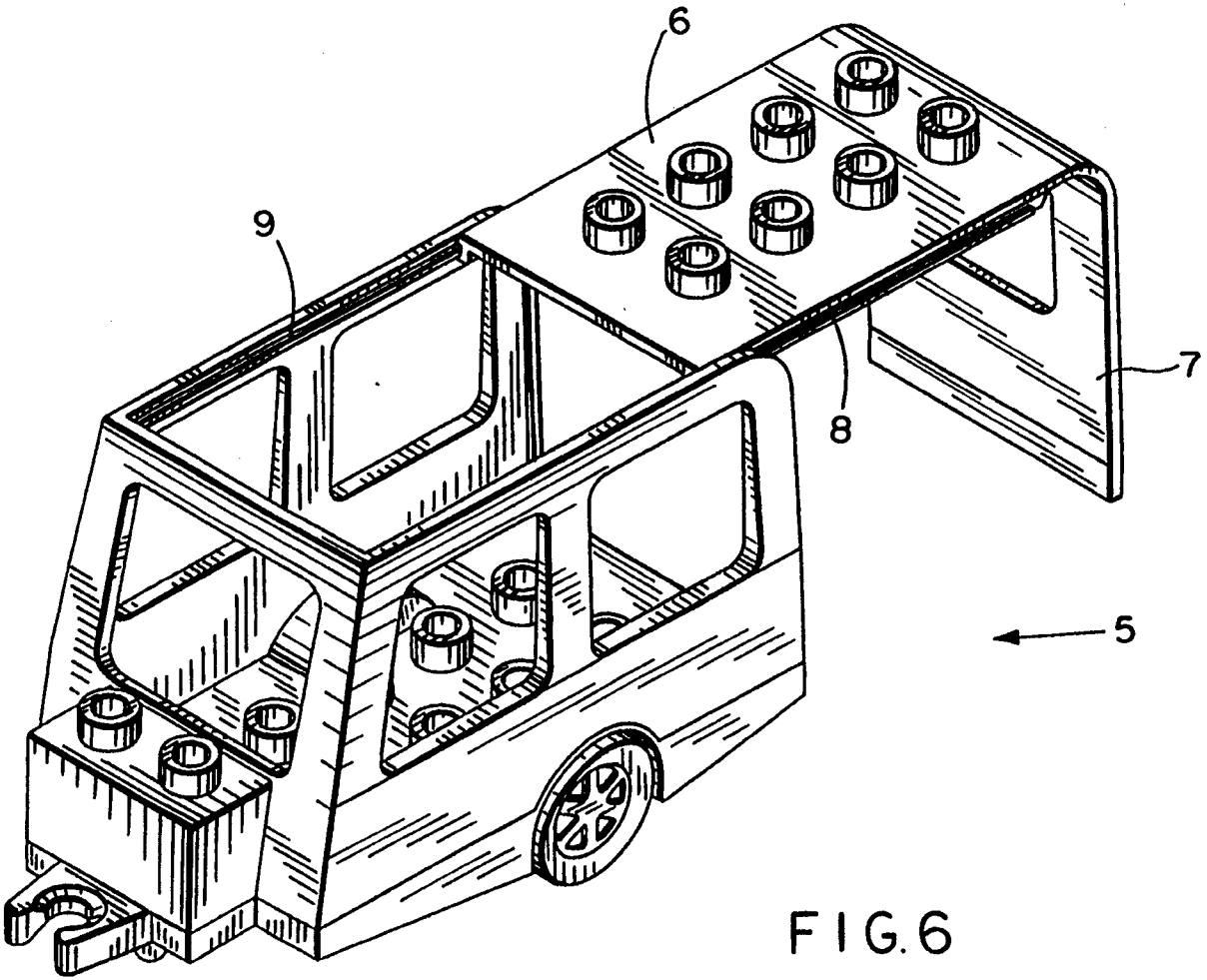

FIGS. 5 and 6 show a toy caravan 5, which will be explained only in relation to the present invention. As appears from FIG. 6, the roof 6 and rear side 7 of the caravan are integral, which facilitates access to the interior of the caravan so that the children can more easily place figures and the like in the caravan. Thus, the roof 6 and the rear side 7 are to be applied and removed frequently during play, and it will be inexpedient if an infant is to try repeatedly to engage the guides 9 on the side of the vehicle with corresponding grooves 8 along the upward side edges of the roof. When the caravan is constructed as explained in connection with FIGS. 1–4, the roof 6 (and the integral rear side 7) can be applied on the caravan merely by pressing the roof downwards between the side walls of the caravan, as was explained in connection with FIG. 4. When the caravan is to be opened, this can be done most easily by sliding the roof 6 rearwardly.

Figure 7:
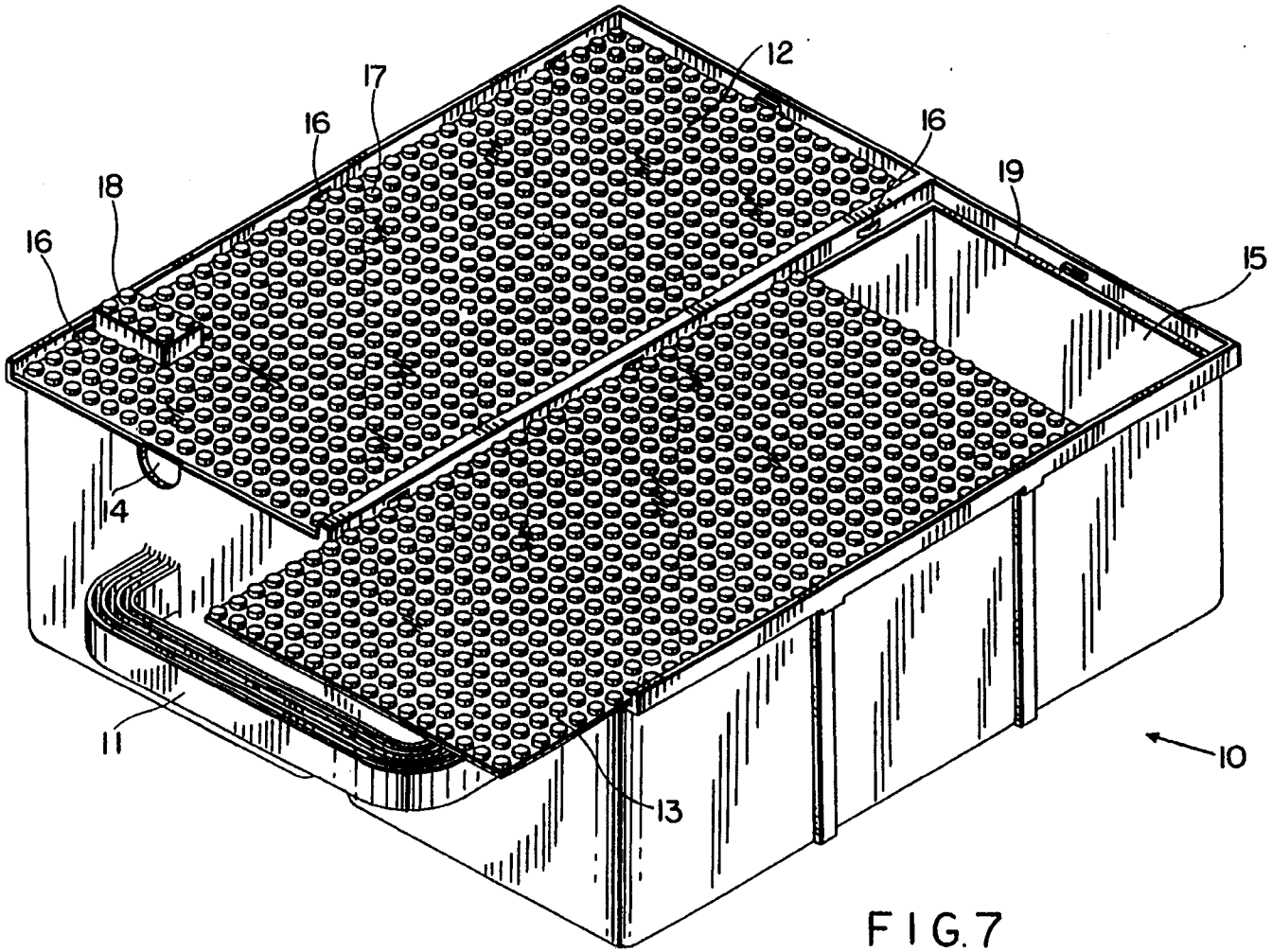
FIG. 7 shows the principle applied to a toy storage box.

FIG. 7 shows another embodiment of the toy of the invention. The figure shows a toy storage box 10 with a handle 11 and two storage compartments behind respective lids 12 and 13. The lid 13 is slid somewhat rearwardly to make the storage compartment 15 visible. In the front side of the storage box there is shown one of two finger holes 14, by means of which the plates 12 and 13 can be gripped and pulled out of the respective guide grooves, which are provided between rebate 19 and projections 16. The projections 16 correspond in principle to the projections 4 in FIG. 1.

It will be appreciated that it may be difficult to move the plates correctly into the grooves when the storage box is to be closed, and that it will be much easier to press the plate downwardly from above, as was explained in connection with FIG. 3, since the plates 12 and 13 are relatively thin and flexible.

In an embodiment where the storage box is primarily intended for storing connectible toy blocks, the plates 12 and 13 are provided with the shown coupling studs 17 so that the plates 12 and 13 may serve as a building base for the connectible toy blocks. FIG. 7 shows such a block 18, and it is noted that the storage box is so dimensioned that the block 18 can be placed so closely to the rim of the storage box that the block cannot pass the projections 16. This may be used for locking the plates 12 and 13 so that they cannot unintentionally slide out of the respective grooves.

What is claimed is:

1. A toy caravan with an accessible interior, said caravan comprising:

a container having a bottom supported above a support surface by attached wheels on an axle and a pair of opposed side walls having a spacing therebetween, a front wall joining said opposed side walls at one end thereof, said front walls and opposed sidewalls defining an established depth of said container and a sliding wall; said sliding wall having a lid portion and a rear wall portion extending downwardly from a rear end of said lid portion for a distance substantially equal to said established depth whereby to provide a rear wall for said container when said lid portion closes said container, said lid portion having a top surface and a pair of opposed parallel edges spaced apart from each other a distance substantially equal to the spacing between said opposed walls; said sliding wall lid portion and opposed walls containing mutually slidable parts consisting of grooves and projecting guides whereby said projecting guides seat within said grooves when said sliding wall is in a closing position; and at least one of said sliding wall and opposed walls being sufficiently elastic to permit said mutual sliding parts to snap into engagement with each other when a transverse force is applied to said sliding wall lid portion when it is positioned over said opposed walls;

and said lid portion top surface having at least one coupling stud for engaging a complementary part of another toy element, said coupling stud extending upwardly from said lid top portion.

2. The toy caravan in accordance with claim 1 wherein said container includes the bottom as a base surface extending between bottom edges of said opposed walls and front wall and further comprising at least one coupling stud extending upwardly from said base surface.

3. A toy in accordance with claim 1 wherein said opposed side walls are each provided at a top end thereof with a rebate to support the sliding wall and a plurality of evenly distributed projections positioned above said rebate by a distance slightly greater than the thickness of said sliding wall whereby to define said grove between said rebate and projections.

4. A toy in accordance with claim 1 wherein said opposed walls are elastically resilient.

5. A toy in accordance with claim 1 wherein said sliding wall is elastically resilient.

6. A toy in accordance with claim 1 wherein said rear wall of said caravan extends downwardly from a rear edge of said sliding wall and is integral therewith.

* * * * *

UNITED STATES PATENT AND TRADEMARK OFFICE

CERTIFICATE OF CORRECTION

PATENT NO. : 5,380,232

DATED : January 10, 1995

INVENTOR(S) : Ib H. Berggreen and Jan Ryaa

It is certified that error appears in the above-indentified patent and that said Letters Patent is hereby corrected as shown below:

On the title page, Item [73], correct the name of the Assignee to read as follows:

INTERLEGO AG

Signed and Sealed this

Fourteenth Day of March, 1995

*Attest:*

*Attesting Officer*

BRUCE LEHMAN

*Commissioner of Patents and Trademarks*